US009580996B2

(12) United States Patent
Sanborn et al.

(10) Patent No.: US 9,580,996 B2
(45) Date of Patent: Feb. 28, 2017

(54) MODULAR ASSEMBLY FOR PROCESSING A FLOWBACK COMPOSITION STREAM AND METHODS OF PROCESSING THE SAME

(71) Applicant: General Electric Company, Schenectady, NY (US)

(72) Inventors: Stephen Duane Sanborn, Copake, NY (US); Imdad Imam, Schenectady, NY (US); Andrew Philip Shapiro, Schenectady, NY (US); John Brian McDermott, Rexford, NY (US); Harish Radhakrishna Acharya, Clifton Park, NY (US); Teresa Grocela Rocha, Clifton Park, NY (US); Jalal Hunain Zia, Niskayuna, NY (US); Johanna Wellington, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 361 days.

(21) Appl. No.: 14/287,547

(22) Filed: May 27, 2014

(65) Prior Publication Data

US 2015/0345258 A1 Dec. 3, 2015

(51) Int. Cl.

| | |
|---|---|
| ***E21B 21/06*** | (2006.01) |
| ***E21B 41/00*** | (2006.01) |
| ***E21B 21/08*** | (2006.01) |

(52) U.S. Cl.

CPC ..... *E21B 41/005* (2013.01); *E21B 21/062* (2013.01); *E21B 21/063* (2013.01); *E21B 21/08* (2013.01)

(58) Field of Classification Search

CPC ..... E21B 41/005; E21B 21/08; E21B 21/063; E21B 21/062; E21B 21/067; E21B 43/34

See application file for complete search history.

(56) References Cited

U.S. PATENT DOCUMENTS 3,493,050 A * 2/1970 Kork ..... E21B 43/2401 166/267

4,374,545 A 2/1983 Bullen et al.

(Continued)

FOREIGN PATENT DOCUMENTS

GB 2348896 A 10/2000

WO 0036272 A1 6/2000

(Continued)

OTHER PUBLICATIONS

International Invitation to Pay Additional Fees issued in connection with corresponding PCT Application No. PCT/US15/027233 dated Sep. 29, 2015.

(Continued)

*Primary Examiner* — Jennifer H Gay

(74) *Attorney, Agent, or Firm* — Armstrong Teasdale LLP

(57) ABSTRACT

A method for processing a flowback composition stream from a well head includes controlling a first flow rate of the flow back composition stream to a second flow rate by regulating the flowback composition stream from a first pressure to a second pressure. The method also includes separating the flowback composition stream into a first gas stream and a condensed stream. The method includes discharging the condensed stream to a degasser and degassing a carbon dioxide rich gas from the condensed stream. The method also includes mixing the carbon dioxide rich gas stream with the first gas stream to produce a second gas stream. The method includes controlling a third flow rate of the second gas stream by regulating a third pressure of the second gas stream to a fourth pressure that is different than the third pressure.

21 Claims, 5 Drawing Sheets

(56) References Cited

U.S. PATENT DOCUMENTS

| | | | | |
|---|---|---|---|---|
| 4,480,696 | A | 11/1984 | Almond et al. | |
| 4,554,082 | A | 11/1985 | Holtmyer et al. | |
| 4,762,543 | A * | 8/1988 | Pantermuehl | C01B 31/20 62/625 |
| 5,271,466 | A | 12/1993 | Harms | |
| 6,234,258 | B1 * | 5/2001 | Karigan | E21B 21/062 166/267 |
| 6,328,118 | B1 * | 12/2001 | Karigan | B01D 21/10 175/206 |
| 6,509,300 | B1 | 1/2003 | Gupta | |
| 6,955,704 | B1 * | 10/2005 | Strahan | B01D 53/22 166/267 |
| 6,962,199 | B1 * | 11/2005 | Tjeenk Willink | B01D 45/16 166/177.2 |
| 7,291,651 | B2 | 11/2007 | Chen et al. | |
| 8,261,823 | B1 | 9/2012 | Hill et al. | |
| 8,316,935 | B1 | 11/2012 | Termine et al. | |
| 8,408,289 | B2 | 4/2013 | Loree et al. | |
| 8,424,599 | B2 | 4/2013 | Atencio | |
| 8,424,784 | B1 * | 4/2013 | Munisteri | E21B 43/267 241/21 |
| 8,518,159 | B2 * | 8/2013 | McCorriston | B01D 19/0005 95/246 |
| 8,528,360 | B2 * | 9/2013 | Betting | F25J 3/0209 62/5 |
| 9,005,339 | B2 * | 4/2015 | Whiteley | E21B 43/34 95/247 |
| 9,133,700 | B2 * | 9/2015 | Lissianski | E21B 43/267 |
| 9,187,996 | B1 * | 11/2015 | Nevison | E21B 43/34 |
| 2005/0092594 | A1 * | 5/2005 | Parro | B01D 53/229 203/72 |
| 2011/0005999 | A1 | 1/2011 | Randal | |
| 2012/0067568 | A1 * | 3/2012 | Palmer | E21B 36/02 166/256 |
| 2012/0085236 | A1 * | 4/2012 | McCorriston | B01D 19/0005 95/259 |
| 2013/0157904 | A1 | 6/2013 | Leshchyshyn et al. | |
| 2013/0180723 | A1 | 7/2013 | Crick et al. | |
| 2013/0206404 | A1 * | 8/2013 | Whiteley | B01D 17/0208 166/267 |
| 2013/0213893 | A1 * | 8/2013 | Posa | C02F 1/004 210/651 |
| 2014/0151051 | A1 * | 6/2014 | Lissianski | E21B 43/267 166/308.1 |
| 2015/0210936 | A1 * | 7/2015 | Burgers | C10G 31/06 208/177 |
| 2015/0345258 | A1 * | 12/2015 | Sanborn | E21B 41/005 166/311 |

FOREIGN PATENT DOCUMENTS

| | | | |
|---|---|---|---|
| WO | 0040834 | A1 | 7/2000 |
| WO | 2009147394 | A1 | 12/2009 |
| WO | 2013022568 | A2 | 2/2013 |

OTHER PUBLICATIONS

International Search Report and Written Opinion issued in connection with corresponding PCT Application No. PCT/US15/027233, dated Jan. 8, 2016.

Taylor et al., "Optimized CO Miscible Hydrocarbon Fracturing Fluids", Canadian International Petroleum Conference, Calgary, Alberta, pp. 1-7, Jun. 2006.

* cited by examiner

MODULAR ASSEMBLY FOR PROCESSING A FLOWBACK COMPOSITION STREAM AND METHODS OF PROCESSING THE SAME

BACKGROUND

The embodiments described herein relate generally to modular processing assemblies, and more particularly, to methods and systems for selectively processing a flow back composition that is discharged from a well head.

As global demand for petroleum and natural gas production grows, the industry will continue to exploit more challenging oil and gas reservoirs, and in particular, reservoirs that may be considered uneconomical due to low formation permeability. Currently, hydraulic stimulation, known as hydro-fracturing, is accomplished using water-based fracturing fluids, wherein a pressurized liquid fractures a geological formation. Typically, water is mixed with proppants, which are solid materials, such as sand and aluminum oxide, and the mixture is injected at high pressure into a wellbore to create small fractures within the geological formation along which fluids such as gas, petroleum, and brine water may migrate to the wellbore. Hydraulic pressure is removed from the wellbore, and then small grains of proppant hold the fractures open once the geological formation achieves equilibrium. As the fracturing fluid flows back through the wellbore, the fluid may consist of spent fluids, natural gas, natural gas liquids, and petroleum and brine waters. In addition, natural formation waters may flow to the wellbore and may require treatment or disposal. These fluids, commonly known as a flowback composition stream, can be managed by surface wastewater treatment.

Hydro-fracturing may include potential environmental considerations, including treatment of large volumes of contaminated water produced during the flowback stage and an increased demand on local freshwater supplies, particularly in arid or otherwise water-stressed areas. Therefore, a need for large volumes of clean water for hydro-fracturing may preclude implementation in some locales. Hydro-fracturing may also pose technical risks relating to water-sensitive reservoirs.

At least some known conventional fracturing procedures have replaced water as the pressurized fluid with other fluids such as carbon dioxide, nitrogen, foams, and/or liquid propane. While these fluids, in comparison to water, provide a means for higher initial production rates and ultimate recovery of the reservoir hydrocarbons, some process challenges may exist associated with handling the post-stimulation flowback stream when using these fluids which can be volatile under ambient temperature and pressure conditions. These challenges include high variability in flow rates as well as gas compositions. The post-stimulation flowback rate is typically very high initially and may decrease by a few orders of magnitude over a period of a few days. Additionally, the gas composition may vary significantly. For example, for a well stimulated with carbon dioxide, the concentration of carbon dioxide in the flowback gas can be high initially such as, for example, over 90% volume, and decrease by an order of magnitude over a period of a few days. A conventional method to accommodate the high flow rates and variability when using these normally volatile fluids is to vent the flowback gas to the atmosphere with no recovery procedure, at least for the first few days of flowback operation. Such venting of these gaseous forms may result in inefficient use of the fluids and/or negative environmental impacts.

BRIEF DESCRIPTION

In one aspect, a method for processing a flowback composition stream from a well head is provided. The method includes receiving the flowback composition stream from the well head, the flowback composition stream having a first flow rate and a first pressure. Method also includes controlling the first flow rate to a second flow rate by regulating the flowback composition stream to a second pressure that is different than the first pressure. The method further includes discharging the flowback composition stream to a separator. The method also includes separating the flowback composition stream into a first gas stream and a condensed stream. The first gas stream is regulated to a third pressure and a third flow rate. The method includes discharging the condensed stream to a degasser and degassing a carbon dioxide rich gas from the condensed stream. The method further includes compressing the carbon dioxide rich gas to the third pressure of the first gas stream. The method also includes mixing the carbon dioxide rich gas with the first gas stream to produce a second gas stream having the third flow rate and the third pressure. The method further includes discharging the second gas stream to a flow modulator. The method includes controlling the third flow rate of the second gas stream by regulating the third pressure of the second gas stream to a fourth pressure that is different than the third pressure.

In another aspect, a modular assembly for processing a flowback composition stream having a first flow rate and a first pressure from a well head is provided. The modular assembly includes a coupler assembly coupled to the well head and having a regulating valve configured to receive the flowback composition stream. The regulating valve is configured to control the first flow rate to a second flow rate by regulating the flowback composition stream to a second pressure that is different than the first pressure. A discharge assembly is coupled in flow communication to the coupler assembly. The discharge assembly includes a separator coupled in flow communication to the regulating valve and configured to separate the flowback composition stream into a first gas stream and a condensed stream having at least one of a gas, proppant, oil, and water. A degasser is coupled in flow communication to the separator and configured to degas a carbon dioxide rich gas from the condensed stream. A flow modulator is coupled in flow communication to the separator and the degasser and configured to mix the carbon dioxide rich gas and the first gas stream to produce a second gas stream having a third flow rate and a third pressure and configured to control the third flow rate by regulating the third pressure to a fourth pressure that is different than the third pressure.

In yet another aspect, a method of assembling a modular assembly for processing a flowback composition stream from a well head is provided. The method includes coupling a coupler assembly to the well head. The coupling assembly has a regulating valve configured to receive the flowback composition stream having a first flow rate and a first pressure and control the first flow rate to a second flow rate by regulating the flowback composition stream to a second pressure that is different than the first pressure. The method includes coupling a separator in flow communication to the regulating valve and configured to separate the flowback composition stream into a first gas stream having a third pressure and third flow rate and a condensed stream. The method also includes coupling a degasser in flow communication to the separator and configured to degas a carbon dioxide rich gas from the condensed stream. The method further includes coupling a flow modulator in flow communication to the separator and the degasser and configured to mix the carbon dioxide rich gas and the first gas stream to produce a second gas stream having a third flow rate and a third pressure and configured to control the third flow rate by regulating the third pressure to a fourth pressure that is different than the third pressure.

In a further aspect, a method for processing a flowback composition stream from a well head is provided. The method includes receiving the flowback composition stream from the well head, the flowback composition stream having an initial flow rate and an initial pressure. The method includes controlling the initial rate to an intermediate flow rate by regulating the flowback composition stream to an intermediate pressure that is less than the initial pressure. The method also includes discharging the flowback composition stream to a separator. The method further includes separating the flowback composition stream into a first gas stream and a condensed stream having at least one of a gas, a proppant, oil, and water. The method includes discharging the condensed stream to a degasser and degassing a carbon dioxide rich gas from the condensed stream. The method includes mixing the carbon dioxide rich gas with the first gas stream to produce a second gas stream. The method also includes discharging the second gas stream to a flow modulator. The method further includes controlling the second gas stream to a final flow rate by modulating the second gas stream to a final pressure that is less than the intermediate pressure.

DRAWINGS

These and other features, aspects, and advantages will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings. The singular forms "a", "an", and "the" include plural references unless the context clearly dictates otherwise. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The embodiments described herein relate to recovery systems and methods of recovering and reusing components of a flowback composition stream that has been discharged from a well head. The embodiments also relate to methods, systems and/or apparatus for controlling the flowback composition stream to facilitate improvement of well production performance. The embodiments describe systems and methods of safely managing the high volumes and variability in the flowback after reservoir stimulation with normally gaseous fluids used as alternate to conventional water-based stimulation. The embodiments also describe systems and methods to recover the stimulation fluid for reuse. It should be understood that the embodiments described herein include a variety of types of well assemblies, and further understood that the descriptions and figures that utilize carbon dioxide gas are exemplary only. The exemplary modular system provides a recovery system that recycles, stores and/or disposes components of the flowback composition stream. The recovery system recaptures a range of components to efficiently operate the well assembly over extended periods of time and/or during variable flow rates.

Figure 1:
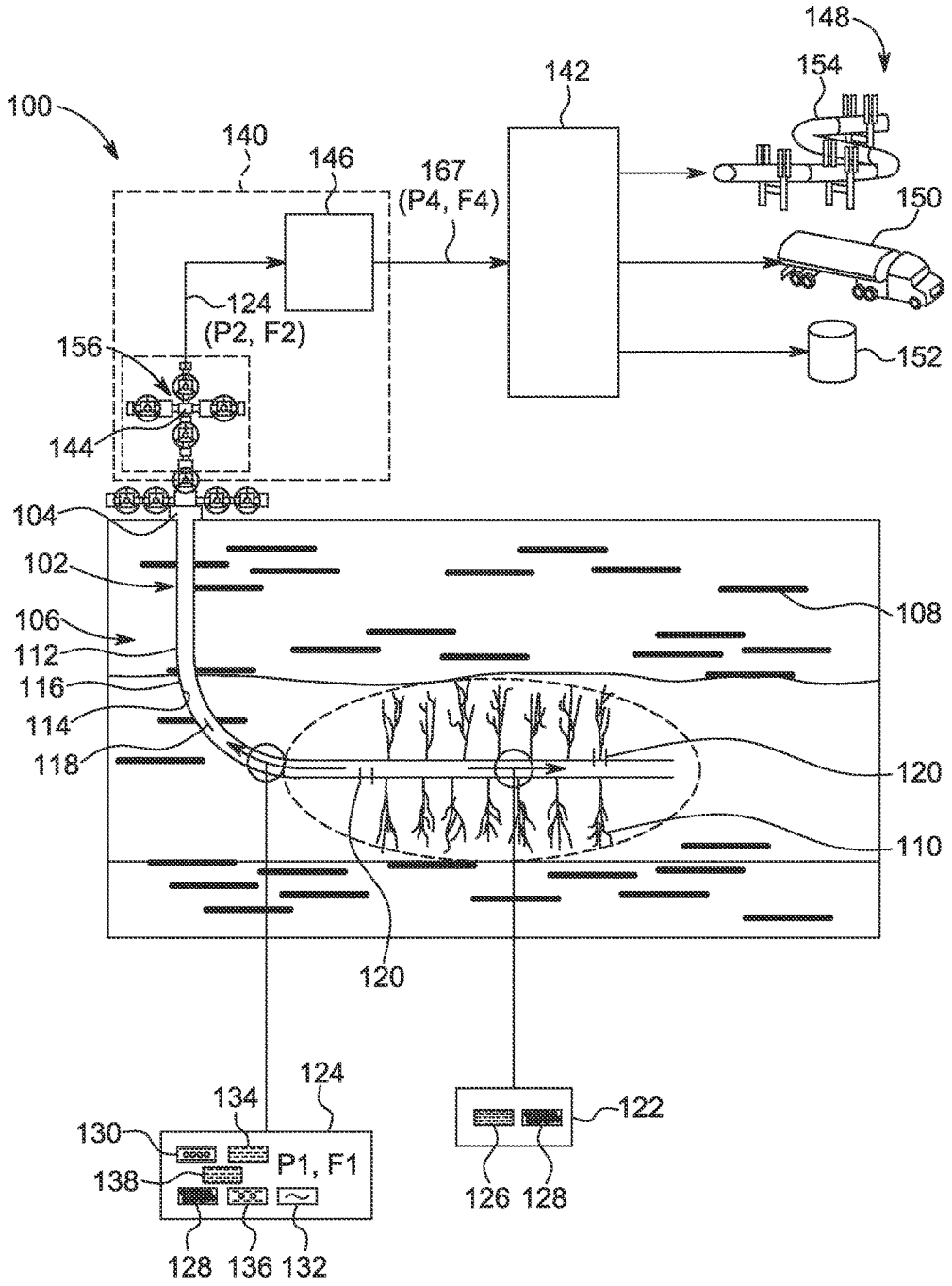
FIG. 1 is a schematic view of an exemplary modular gas recovery system coupled to a wellbore having a flowback composition stream.

FIG. 1 is a side elevation view of a recovery system 100 coupled to a wellbore 102 through a well head 104. Recovery system 100 is designed for deployment on a well site 106 within a geological formation 108 containing desirable production fluids 110, such as, but not limited to, petroleum. In the exemplary embodiment, recovery system 100 is used with unconventional geological formations 108 such as, but not limited to, a tight-oil reservoir and a shale-gas reservoir. Alternatively, recovery system 100 can be used with any geological formation 108. Wellbore 102 is drilled into geological formation 108 and lined with a well casing 112. Well casing 112 includes an inner sidewall 114 and an outer sidewall 116 which are horizontally and/or vertically located within geological formation 108. Inner sidewall 114 defines a channel 118 in flow communication with well head 104. Well casing 112 may be positioned in any orientation within geological formation 108 to enable recovery system 100 to function as described herein. Moreover, well casing 112 may be cased or uncased. A plurality of perforations 120 is formed through well casing 112 to permit a fracturing fluid 122 to flow from channel 118 and into geological formation 108 during a pressurized fracturing process. Subsequent to the fracturing process, perforations 120 permit petroleum fluid 110 to flow from geological formation 108 and into channel 118. Moreover, channel 118 is configured to receive and direct a resultant flowback composition stream 124 from geological formation 108 and to well head 104.

In the exemplary embodiment, fracturing fluid 122 includes at least one of carbon dioxide liquid 126 and a plurality of proppants 128. Alternatively, fracturing fluid 122 may include water mixed with the carbon dioxide liquid to provide a foam-type fracturing fluid. Alternatively, fracturing fluid 122 can include any type of fluid to enable recovery system 100 to function as described herein. Moreover, flowback composition stream 124 includes at least one of proppant 128, carbon dioxide gas 130, water 132, oil 134, natural gas 136, natural gas liquid 138, and other byproducts (not shown). Natural gas liquid 138 may include the commonly used reference of hydrocarbons that may be recovered as a condensed liquid whereas natural gas 136 may include a predominantly methane-rich stream. Channel 118 is configured to receive flowback composition stream 124 and direct flowback composition stream 124 to well head 104. Flowback composition stream 124 includes an initial pressure such as, for example a first pressure P1, having a range from about 50 pounds per square inch ("psi") to about 10,000 psi. More particularly, first pressure P1 includes a range from about 500 psi to about 5,000 psi. Moreover, flowback composition stream 124 at well head 104 has an initial flow rate such as, for example a first flow rate F1, having a range from about 0.1 million Standard Cubic Foot per Day ("scfd") to about 300 million scfd. More particularly, first flow rate F1 has a range from about 1 million scfd to about 200 million scfd. Alternatively, flowback composition stream 124 may include any pressure and flow rate.

Figure 2:
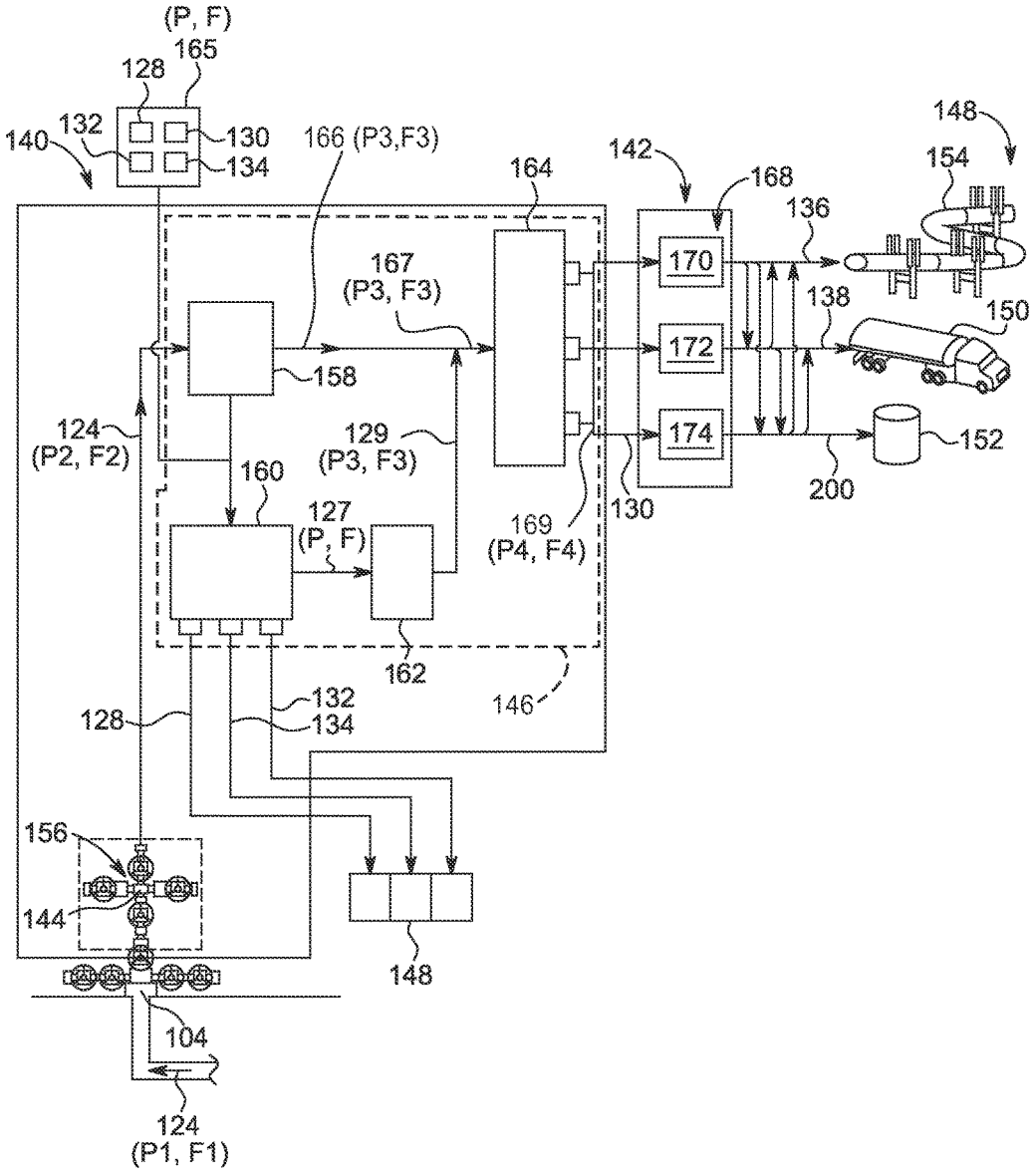
FIG. 2 is a schematic view of a modular assembly of the gas recovery system shown in FIG. 1.

FIG. 2 is a schematic view of a modular assembly 140 of recovery system 100. Recovery system 100 includes modular assembly 140 and a gas processor assembly 142 removably coupled inflow communication thereto. In the exemplary embodiment, modular assembly 140 includes a coupler assembly 144 and a discharge assembly 146. Modular assembly 140 is configured such that coupler assembly 144 and discharge assembly 146 can be prefabricated at an off-site fabrication shop (not shown) and delivered as a modular unit to well site 106 for convenient and efficient connection to well head 104. Alternatively, coupler assembly 144 and discharge assembly 146 can be prefabricated as a modular unit and coupled to a truck platform (not shown) for mobile use of recovery system 100 at a plurality of different well sites 106. Still further, alternatively, coupler assembly 144 and discharge assembly 146 can be shipped to well site 106 as a kit (not shown) and conveniently fabricated into modular assembly 140 at well site 106.

In the exemplary embodiment, gas processor assembly 142 is coupled to discharge assembly 146. In an embodiment, gas processor assembly 142 can be delivered as a modular unit to well site 106 for convenient and efficient connection to discharge assembly 146. Alternatively, gas processor assembly 142 can be prefabricated and coupled to discharge assembly 146 and delivered as a modular unit with discharge assembly 146. Recovery system 100 further includes a collector 148 coupled in flow communication to at least one of modular assembly 140 and gas processor assembly 142. In the exemplary embodiment, collector 148 includes at least one of a tanker truck 150, a storage container 152, and a pipeline 154. Collector 148 is configured to collect components of flowback composition stream 124 post-fracturing for reuse, storage and/or disposal as described herein.

Coupler assembly 144 includes at least one regulating valve 156 coupled in flow communication to well head 104 and discharge assembly 146. Regulating valve 156 is configured to receive flowback composition stream 124 from well head 104. Regulating valve 156 is further configured to provide a convenient and efficient connect/disconnect to selectively accommodate a variety of modular assemblies 140. Regulating valve 156 is configured to receive flowback composition stream 124 from well head 104. Moreover, regulating valve 156 is configured to regulate first flow rate F1 to an intermediate flow rate, for example a second flow rate F2, by regulating an intermediate back pressure, for example a back pressure P2, in relation to first pressure P1. In the exemplary embodiment, second pressure P2 is different than first pressure P1. More particularly, regulating valve 156 is configured to reduce first pressure P1 to second pressure P2 to regulate first flow rate F1 to second flow rate F2. In the exemplary embodiment, second pressure P2 includes a range from about 50 psi to about 2000 psi. Alternatively, second pressure P2 can be substantially the same as or greater than first pressure P1 and can include any pressure range.

Parameters of second pressure P2 can depend on the composition of flowback composition stream 124 and second flow rate F2 required to effectively and economically separate component products in the various downstream equipment chosen in discharge assembly 146 and gas processor assembly 142. The sizes of the various equipment of discharge assembly 146 and gas processor assembly 142 can be designed based on anticipated conditions at well head 106 in terms of, for example, flow rates, gas compositions and desired separation into end-product gas, liquid and/or solid streams. During the flow back at well site 106, there can be a significant variation in flow back rates and gas composition of flowback composition stream 124. In equipment (not shown) typically used for separation of gases from liquid streams, such as vapor/liquid separation vessels, absorbers, coalescers, the equipment is sized proportional to the gas residence time in the vessel. This residence time can be obtained by dividing the equipment size divided by the actual gas flow rate through the vessel.

In the exemplary embodiment, when the initial flowback molar rates of flowback composition stream 124 are high, higher values of second pressure P2 may be chosen in order to control by reducing and/or increasing actual gas flow rates so that the available equipment designed for target residence times may provide the desired separation. Moreover, when the flowback molar rates of flowback composition stream 124 are lower, typically during later periods of the flowback process, lower values of second pressure P2 may be chosen since the available separation equipment may be able to manage the required separation duty at higher actual gas flow rates. The values for the second pressure P2 may be defined by considerations of how much gas would be dissolved in the liquid portion during separation as this would entail a higher gas removal duty in a degasser, since the solubility of gas in water and oil portions of the flowback composition stream 124 would be higher at higher values of second pressure P2. Regulating valve 156 is configured to direct flowback composition stream 124 at second pressure P2 and second flow rate F2 to discharge assembly 146. Regulating valve 156 is configured to control first flow rate F1 to second flow rate F2 by regulating first pressure P1 to second pressure P2 to facilitate presenting a steadier, predictable flow of flowback composition stream 124 from well head 104 and to discharge assembly 146. In an embodiment, second pressure P2 includes a range from about 50 psi to about 2000 psi. Moreover, second flow rate F2 includes a range from about 0.1 million scfd to about 200 million scfd. Alternatively, second pressure P2 and second flow rate F2 can include any ranges to enable recovery system 100 to function as described herein.

Moreover, regulating valve 156 is configured to manage second flow rate F2 so that gas processor module 142 can effectively separate flowback composition stream 124 to the desired end-products. More particularly, when flowback composition stream 124 is anticipated to be high as during initial use, modular assembly 140 is configure to economically capture carbon dioxide instead of venting or flaring given the limitations of available footprint and other constraints (i.e., power, emissions regulations, etc.) at well site 106.

In the exemplary embodiment, coupler assembly 144 is configured to regulate the flowback rates and/or pressure rates of flowback composition stream 124 to be handled by gas recovery system 100 at well site 106. At well site 106, there are constraints on available space for locating the various equipment associated with recovery system 100. Recovery system 100 is configured to size the equipment and the process operating conditions to reduce the footprint occupied by recovery system 100 while also reducing the set-up, operational, and/or maintenance costs. Additionally, there may be constraints on the handling and delivery of the end-products of gas recovery system 100 away from well site 106. If the CO2-product was a liquid transported via refrigerated trucks then a high rate of CO2-capture and processing by system 100 would entail a high rate of CO2-product transportation out of well site 106. In another exemplary embodiment, if the natural gas product were to be discharged into collector 148, for example, a pipeline then the rate of discharge of product would be constrained by the flow capacity of pipeline 184. By regulating second flow rate F2, regulating valve 156 is configured to control flowback so that recovery system 100 is optimally designed and operated economically-viable conditions while allowing the discharge of the end-products from recovery system 100. Moreover, recovery system 100 is configured to facilitate deployment of post-stimulation carbon dioxide recovery that can be accomplished at well head 104 where footprint space can be limiting.

In the exemplary embodiment, discharge assembly 146 includes a separator 158, a degasser 160, a compressor 162, and a flow modulator 164. Separator 158 is coupled in flow communication to coupler assembly 144 and is configured to receive flowback composition stream 124 from coupler assembly 144. More particularly, separator 158 is configured to separate the gas components in flowback composition stream 124 to form a first gas stream 166 such as, for example a modified gas stream, and a condensed stream 165. Condensed gas stream 165 includes at least one of the condensed phases such as, but not limited to, proppants 128 (if any), water 132, and oil 134. The operating pressure of separator 158 can be close in value to second pressure P2, although can be lower due to, for example, frictional pressure losses in the equipment of separator 158. Depending on the flowback flow rates, composition and/or the separation desired, separator 158 is configured to regulate first gas stream 166 to a third pressure P3 and a third flow rate F3. In the exemplary embodiment, third pressure P3 is different than second pressure P2 and third flow rate F3 is different than second flow rate F2. More particularly, third pressure P3 is less than second pressure P2 for example by friction pressure losses. In an embodiment, third pressure P3 includes a range from about 50 psi to about 2000 psi. Moreover, third flow rate F3 includes a range from about 0.1 million scfd to about 200 million scfd. Alternatively, third pressure P3 and third flow rate F3 can include any ranges to enable recovery system 100 to function as described herein.

Separator 158 is coupled in flow communication with degasser 160 via condensed stream 165 and coupled in flow communication to flow modulator 164. Separator 158 is configured to discharge first gas stream 166 toward flow modulator 164 and condensed stream 165 toward degasser 160. Separator 158 includes a gas-liquid disengagement zone and/or other components such as, but not limited to, coalescers and filters to remove fine liquid droplets in the gas phase; the latter may be achieved via coalescers, filters and such means. In degasser 160, any dissolved carbon dioxide and other gases are removed from condensed phase stream 165. In the exemplary embodiment, degassing in degasser 160 is facilitated by decreasing the pressure and/or increasing the temperature of condensed stream 165. The degassing operation in degasser 160 facilitates forming a modified carbon dioxide rich gas 127 and removing of at least one of proppants 128, water 130, and oil 134 from condensed stream 165. Degasser 160 is configured to yield at least one of proppants 128, water 132, and liquid oil 134 with the gaseous content in each of these streams being sufficiently low to meet the end-product specifications for these streams. Degasser 160 may include operating conditions that facilitate the removal of dissolved gases in the liquids oil 134 and water 132 by release of pressure and/or by an increase in temperature.

Degasser 160 is coupled in flow communication to separator 158 and configured to receive condensed stream 165. In the exemplary embodiment, degasser 160 is configured to separate or degas carbon dioxide rich gas 127 from condensed stream 165. Degasser 160 is configured to discharge degassed carbon dioxide rich gas 127 at a pressure P and a flow rate F to compressor 162. In the exemplary embodiment, pressure P is less than second pressure P2 and flow rate F is less than second flow rate F2. Alternatively, pressure P and flow rate F can be substantially the same as or greater than second pressure P2 and second flow rate F2, respectively. Moreover, degasser 160 is configured to discharge at least one of proppants 128, water 132, and oil 134 to appropriate collector 148 such as, for example, truck 150, container 152, and pipeline 154.

Compressor 162 is coupled in flow communication to degasser 160 and is configured to receive carbon dioxide rich gas 127 from degasser 160. Compressor 162 is configured to increase pressure of degassed carbon dioxide rich gas 127 to facilitate forming stream 129. In the exemplary embodiment, compressor 162 is configured to increase pressure P to third pressure P3. Compressor 162 may include a plurality of compressors to increase pressure of degassed carbon dioxide rich gas 127. Compressor 162 includes gas compression equipment (not shown) such as, for example, multiple-stages of compression and includes cooling of the compressed gas at each of the inter-mediate compression stages and of the final compressed gas stream. Compressor 162 may also include equipment (not shown) to separate and collect any liquids formed during the cooling. Compressor 162 is configured to discharge degassed carbon dioxide rich gas 127 toward flow modulator 164 and mix carbon dioxide rich gas 127 with first gas stream 166 exiting separator 158. The mixing of first gas stream 166 and degassed carbon dioxide rich gas 127 facilitates forming a second gas stream 167 at third pressure P3 and third flow rate F3 which is discharged to flow modulator 164. First gas stream 166 and carbon dioxide rich gas 127 can mix and form second gas stream 167 prior to entering flow modulator 164. Alternatively, flow modulator 164 is configured to receive first gas stream 166 and carbon dioxide rich gas 127 separately for subsequent mixing to facilitate forming second gas stream 167.

Flow modulator 164 is coupled in flow communication to separator 158 and compressor 162 and is configured to receive second gas stream 167. Flow modulator 164 is configured to control or modify third flow rate F3 of second gas stream 167 and manage third flow rate F3 to a fourth flow rate F4 by modulating second third P3 to a fourth pressure P4 which is different than third pressure P3 to form a modulated gas stream 169. Control or modification of third flow rate F3 to the fourth flow rate F4 may be accomplished by reducing third pressure P3 to fourth pressure P4. Alternatively, flow modulator 164 can increase third pressure P3 to fourth pressure P4. Characteristics for pressure P4 can be designed upon by the separation capabilities of separation module 142. In the exemplary embodiment, fourth flow rate F4 has a range from about 10,000 actual cubic feet per day and 10 million actual cubic feet per day. Moreover, fourth pressure P4 has a range from about 50 psi to about 1,500 psi. More particularly, fourth pressure P4 has a range from about 50 psi to about 800 psi. Flow modulator 164 is configured to regulate and/or modulate third flow rate F3 to fourth flow rate F4 and third pressure P3 to fourth pressure P4 to facilitate providing a steadier, predictable flow of modulated gas stream 169 to gas processor assembly 142. More particularly, flow modulator 164 is efficiently designed to produce a controllable pressure and flow rate (i.e., fourth pressure P4 and fourth flow rate F4) for discharging modulated gas stream 169 to gas processor assembly 142. Moreover, gas processor assembly 142 is efficiently designed based on the predetermined and controlled pressure and flow rate of modulated gas stream 169.

Gas processor assembly 142 is configured to receive modulated gas stream 169 from flow modulator 164 at, for example only, fourth pressure P4 and fourth flow rate F4. Gas processor assembly 142 includes a plurality of separation modules 168 coupled in flow communication to flow modulator 164. Each separation module 168 such as, for example, separation module 170, separation module 172, and separation module 174 are removably coupled to flow modulator 164. Although three separation modules 170, 172, and 174 are shown, the plurality of separation modules 168 may include a single separation module, less than three separation modules, or more than three separation modules to enable gas processor assembly 142 to function as described herein.

The plurality of separation modules 168 is removably coupled to flow modulator 164 to provide a modular flowback management scheme for modulated gas stream 169, and in particular, for carbon dioxide gas present within modulated gas stream 169. More particularly, the plurality of separation modules 168 is sized to accommodate for different flow rates and pressures of modulated gas stream 169 over time. Accordingly, different number of separation modules 168 are removably coupled to flow modulator 164 and employed over time to accommodate different operating parameters of well head 104 over time. For example, well head 104 can provide increased initial flow and/or pressures of flowback composition stream 124 at initial operating times. The higher initial top side flows and/or pressures can reduce over flowback times. At increased operational flows and/or pressures, the number of separation modules 168 is selectively coupled flow modulator 164 to accommodate the increased operating parameters. As flow rates and/or pressures decrease over flowback time, separation modules 170, 172, and 174 are selectively decoupled from discharge assembly 146 to accommodate for reduced flows and/or pressures. Accordingly, the number of separation modules 170, 172, and 174 that are employed by modular assembly 140 can be selectively varied over time.

The decoupled separation modules 170, 172, and 174 can remain at well site 106 for subsequent reconnection to discharge assembly 146 and/or for subsequent reconnection to another well head (not shown). Alternatively, decoupled separation modules 170, 172, and 174 can be efficiently shipped to another well site (not shown) for subsequent use. The modularity of separation modules 170, 172, and 174 facilitate accommodating varying operating parameters of well site 106; increase efficiency of well site 106; increase operating life of well site 106; and reduce maintenance and/or operating costs of well site 106.

In the exemplary embodiment, at least one of separation module 170, 172, 174 is configured to process and/or separate modulated gas stream 169 at, for example only, fourth pressure P4 and fourth flow rate F4. More particularly, at least one of separation module 170, 172, and 174 is configured to process modulated gas stream 169 to produce at least one of a purified carbon dioxide stream, a natural gas stream, and a natural gas liquid stream. At least one separation module 170, 172, and 174 are configured to discharge natural gas 136 to collector 148 such as, but not limited to, pipeline 154. Discharged natural gas 136 can be stored and/or used as, but not limited to: a flared or vented gas; a fuel source for power production; a compressed natural gas product; and/or a sales product which may include gas that is distributed via a gathering line (not shown) to a gas-processing facility (not shown). Moreover, at least one of separation module 170, 172, and 174 is configured to discharge natural gas liquid 138 to collector 148 such as, but not limited to, tanker truck 150, container 152, and pipeline 154.

In the exemplary embodiment, at least one of separation module 170, 172, and 174 is configured to process and/or separate carbon dioxide gas into a plurality of carbon dioxide states 200. The plurality of carbon dioxide states 200 include, but are not limited to, a liquid carbon dioxide, a high pressure carbon dioxide gas, and a low pressure carbon dioxide gas. At least one of separation module 170, 172, and 174 is configured to discharge the plurality of carbon dioxide states 200 to collector 148 such as, but not limited to, tanker truck 150, container 152, and pipeline 154.

Figure 3:
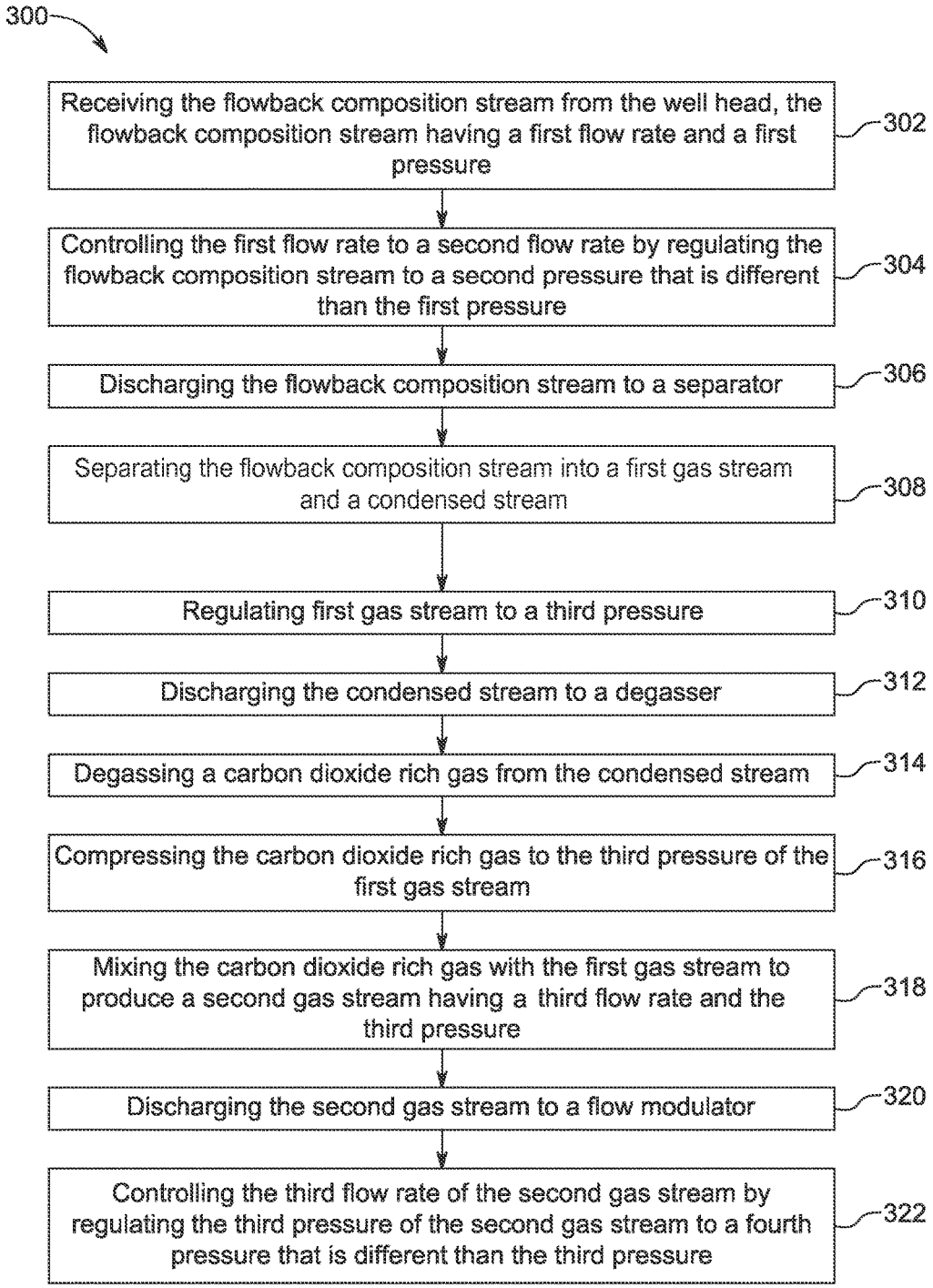
FIG. 3 is a flowchart illustrating an exemplary method of processing a flowback composition stream.

FIG. 3 is a flowchart illustrating a method 300 of processing a flowback composition stream, such as flowback composition stream 124 (shown in FIG. 1), from well head 106 (shown in FIG. 1). Flowback composition stream 124 has first flow rate F1 and first pressure P1 (shown in FIG. 1). Method 300 includes receiving 302 flowback composition stream 124 from well head 106. Moreover, method 300 includes controlling 304 first flow rate F1 to second flow rate F2 by regulating flowback composition stream 124 to second pressure P2 that is different than first pressure P1 (all shown in FIG. 2). In the exemplary method 300, flowback composition stream 124 is discharged 306 to separator 158 (shown in FIG. 2).

Separator separates 308 flowback composition stream 124 into first gas stream 166 and condensed stream 165 (all shown in FIG. 2). Condensed stream 165 includes at least one of proppants 128, carbon dioxide gas 130, water 132, and oil 134 (all shown in FIG. 2). Method 300 includes regulating 310 first gas stream 166 to third pressure P3 (all shown in FIG. 2). Condensed stream 165 is discharged 312 to degasser 160 (shown in FIG. 2). Method 300 includes degassing 314 carbon dioxide rich gas 127 (shown in FIG. 2) from condensed stream 165.

Method 300 includes compressing 316 carbon dioxide rich gas 127 to third pressure P3 of first gas stream 166. Carbon dioxide rich gas 127 is mixed 318 with first gas stream 166 to facilitate forming second gas stream 167 (shown in FIG. 2). Method 300 includes discharging 320 second gas stream 167 to flow modulator 164 (shown in FIG. 2). Moreover, method 300 includes controlling 322 third flow rate F3 of second gas stream 167 to fourth flow rate F4 by modulating third pressure to fourth pressure P4 (all shown in FIG. 2) that is different than third pressure P3.

Figure 4:
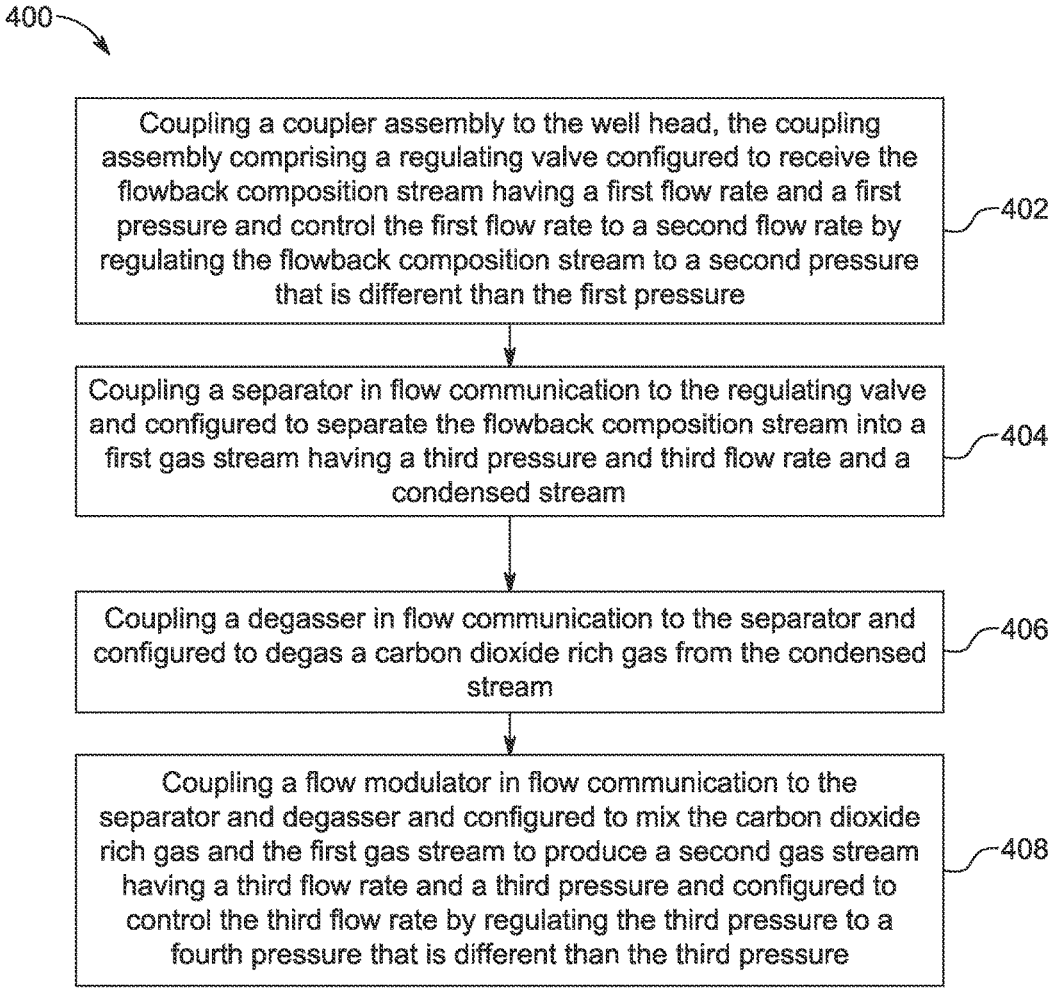
FIG. 4 is a flowchart illustrating an exemplary method of assembling a modular assembly for processing a flowback composition stream.

FIG. 4 is a flowchart illustrating a method 400 of assembling a modular assembly, such as modular assembly 140 (shown in FIG. 2), for processing a flowback composition stream, such as flowback composition stream 124 (shown in FIG. 2), from a well head, for example well head 106 (shown in FIG. 1). Method 400 includes coupling 402 coupler assembly 144 to well head 106. Coupler assembly 144 includes regulating valve 156 (shown in FIG. 1) that is configured to receive flowback composition stream 124 having first flow rate F1 and first pressure P1. Regulating valve 156 is configured to control first flow rate F1 to second flow rate F2 by regulating flowback composition stream 124 to second pressure P2 which is different than first pressure P1 (all shown in FIG. 2).

Separator 158 (shown in FIG. 2) is coupled in flow communication to regulating valve 156 and is configured to separate flowback composition stream 124 into first gas stream 166 at a third pressure P3 and a third flow rate F3 and condensed stream 165 (all shown in FIG. 2). Condensed stream 165 includes at least one of proppants 128, carbon dioxide gas 130, water 132, and oil 134 (all shown in FIG. 2). Method 400 includes coupling 406 degasser 160 (shown in FIG. 2) in flow communication to separator 158. Degasser 160 is configured to degas carbon dioxide rich gas 127 (shown in FIG. 7) from condensed stream 165. Flow modulator 164 (shown in FIG. 2) is coupled 408 in flow communication to separator 158. Flow modulator is configured to control third flow rate F3 by regulating third pressure P3 to fourth pressure P4 that is different than third pressure P3 (all shown in FIG. 2).

Figure 5:
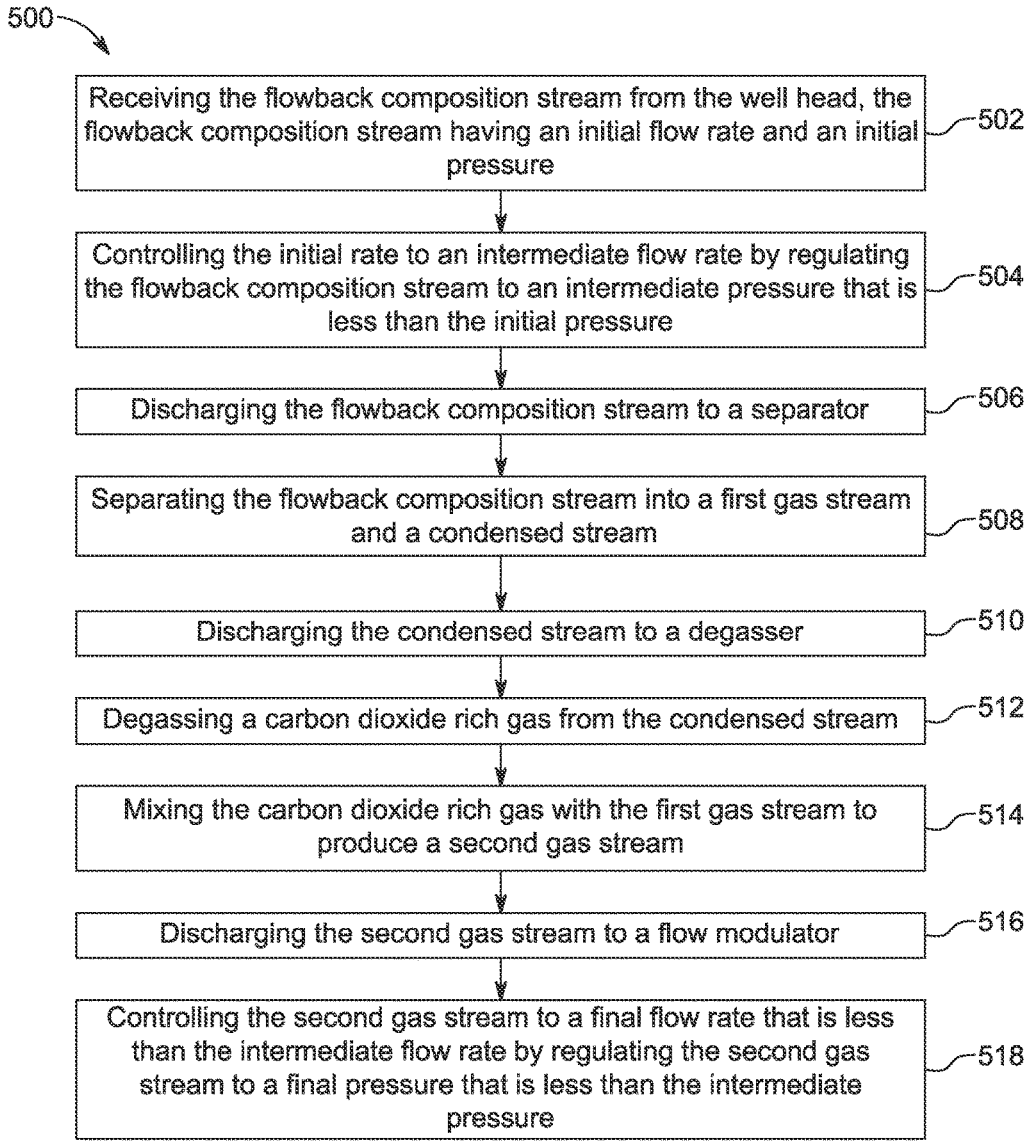
FIG. 5 is a flowchart illustrating an exemplary method of processing a flowback composition stream.

FIG. 5 is a flowchart illustrating a method 500 of processing a flowback composition stream, such as flowback composition stream 124 (shown in FIG. 1), from well head 106 (shown in FIG. 1). Flowback composition stream 124 has initial flow rate F1 and initial pressure P1 (all shown in FIG. 1). Method 500 includes receiving 502 flowback composition stream 124 from well head 106. Moreover, method 500 includes controlling 504 initial flow rate F1 to intermediate flow rate F2 by regulating flowback composition stream 124 to intermediate pressure P2 that is different than initial pressure P1 (all shown in FIG. 2). In the exemplary method 500, flowback composition stream 124 is discharged 506 to separator 158 (shown in FIG. 2).

Separator separates 508 flowback composition stream 124 into first gas stream 166 and condensed stream 165 (all shown in FIG. 2). Condensed stream 165 includes at least one of proppants 128, carbon dioxide gas 130, water 132, and oil 134 (all shown in FIG. 2). Condensed stream 165 is discharged 510 to degasser 160 (shown in FIG. 2). Method 500 includes degassing 512 carbon dioxide rich gas 127 (shown in FIG. 2) from condensed stream 165. Carbon dioxide rich gas 127 is mixed 518 with first gas stream 166 to facilitate forming second gas stream 167 (shown in FIG. 2). Method 500 includes discharging 520 second gas stream 167 to flow modulator 164 (shown in FIG. 2). Moreover, method 500 includes controlling 522 second gas stream 167 to final flow rate F4 by regulating second gas stream 165 to final pressure P4 that is less than intermediate pressure P2 (all shown in FIG. 2).

The exemplary embodiments described herein provide for a modular gas recovery system for use with a liquid carbon dioxide fracturing process. As a fracturing fluid, liquid carbon dioxide provides advantages as compared to water stimulation such as, but not limited to vaporization at formation temperatures and increased well productivity. Moreover, liquid carbon dioxide as a fracturing fluid, minimizes and/or and eliminates a need for water transportation, water treatment and/or water disposal to support water-based fracturing operations. Furthermore, liquid carbon dioxide is miscible in liquid hydrocarbons, such as petroleum formation fluid, to facilitate reducing viscosity of formation flow, and is readily phase-separated to increase well productivity.

The exemplary embodiments described herein provide separation processes useful for carbon dioxide stimulation and flowback management that can employ a range of equipment such as, but not limited to, separation vessels, compressor, turbo expanders, vacuum pumps, liquid pumps, selective gas-separation membranes, absorption solvents, distillation columns (demethanizers), sorbents for undesired components ($H_2S$), dehydration (glycol columns or sorbents) storage vessels for gas, liquids, and solids, and/or solids handling, storage, and disposal equipment. The exemplary embodiments can be integrated and controlled with a robust control system (not shown).

The embodiments described herein provide cost-effective and transportable carbon dioxide recapture/recycling systems that facilitate wide-spread adoption of liquid carbon dioxide stimulation and the commensurate displacement of other fracturing stimulations. More particularly, the exemplary embodiments enable waterless stimulation; mitigate wastewater handling issues; allow improved development of water-sensitive formations; and allow development of unconventional oil and gas resources in water-scarce regions.

For geological formations such as, for example, a tight-oil formation, the exemplary embodiments compensate for high-initial and/or sharply-declining gas flow rates and high-initial and/or moderately-declining carbon dioxide concentrations in flowback or subsequent gas production while providing high oil-recovery and optimal reuse-quality carbon dioxide recovery. For a shale gas system, the exemplary embodiments compensate for high-initial and/or moderately-declining gas flow rates and moderate-initial and/or sharply-declining carbon dioxide concentrations while providing gathering-pipeline quality gas and optimal reuse-quality carbon dioxide recovery. During conditions of high flow rate, for example, as encountered during the initial flowback, several of the exemplary modular assemblies can be employed. As the flow rate decreases with flowback time, the number of modular assemblies employed can be proportionately decreased and the modular assemblies can be re-deployed at other geological formation sites.

The embodiments described herein enable carbon dioxide stimulation to supplant hydro-fracturing and provides benefits to energy producers since carbon dioxide stimulations are known to yield higher estimated utilization recovery and higher productivity. Moreover, the exemplary embodiments provide a justification to encourage local anthropogenic carbon dioxide capture from sources such as, but not limited to, power plants, refineries and the chemical industry for the carbon dioxide stimulation market, which can reduce greenhouse emissions as a secondary benefit to the improved tight-oil and/or shale-gas production.

A technical effect of the systems and methods described herein includes at least one of: (a) modularizing gas recovery from a well site; (b) recovering components of a flowback composition stream for reuse, recycle, storage, and/or disposal; (c) facilitating waterless stimulation; (d) mitigating wastewater handling issues; (e) facilitating improved development of water-sensitive formations; (f) facilitating development of unconventional oil and gas resources in water-scarce regions; and, (g) decreasing design, installation, operational, maintenance, and/or replacement costs for carbon dioxide fracturing process at well site.

Exemplary embodiments of a modular gas recovery assembly and methods for assembling a modular gas recovery assembly are described herein. The methods and systems are not limited to the specific embodiments described herein, but rather, components of systems and/or steps of the methods may be utilized independently and separately from other components and/or steps described herein. For example, the methods may also be used in combination with other manufacturing systems and methods, and are not limited to practice with only the systems and methods as described herein. Rather, the exemplary embodiment may be implemented and utilized in connection with many other fluid and/or gas applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for processing a flowback composition stream from a well head, said method comprising:

receiving the flowback composition stream from the well head, the flowback composition stream having a first flow rate and a first pressure;

controlling the first flow rate to a second flow rate by regulating the flowback composition stream to a second pressure that is different than the first pressure, wherein regulating the flowback composition stream to the second pressure is based, at least in part, on a flowback molar rate of the flowback composition stream;

discharging the regulated flowback composition stream to a separator;

separating the regulated flowback composition stream into a first gas stream and a condensed stream;

regulating the first gas stream to a third pressure and a third flow rate;

discharging the condensed stream to a degasser;

degassing a carbon dioxide rich gas from the condensed stream;

compressing the carbon dioxide rich gas to the third pressure of the first gas stream;

mixing the carbon dioxide rich gas with the first gas stream to produce a second gas stream having the third flow rate and the third pressure;

discharging the second gas stream to a flow modulator; and controlling the third flow rate of the second gas stream by regulating the third pressure of the second gas stream to a fourth pressure that is different than the third pressure.

2. The method of claim 1 further comprising discharging the second gas stream from the flow modulator to at least one gas processor.

3. The method of claim 1 further comprising processing the second gas stream at the fourth pressure to produce at least one of a purified carbon dioxide stream, a natural gas stream, and a natural gas liquid.

4. The method of claim 1 further comprising processing the second gas stream into a plurality of carbon dioxide states.

5. The method of claim 1 further comprising reducing the first pressure to the second pressure.

6. The method of claim 1 further comprising managing the first flow rate to the second flow rate.

7. The method of claim 1 further comprising reducing the second pressure to the third pressure.

8. The method of claim 1 further comprising discharging the carbon dioxide rich gas to a compressor.

9. The method of claim 1 further comprises collecting at least one of a proppant, oil, and water from the condensed stream.

10. The method of claim 1, wherein controlling the third flow rate of the second gas stream comprises regulating the third pressure of the second gas stream to the fourth pressure having a range from about 50 pounds per square inch ("psi") to about 800 psi.

11. A modular assembly for processing a flowback composition stream having a first flow rate and a first pressure from a well head, said modular assembly comprising:

a coupler assembly coupled to the well head and comprising a regulating valve configured to receive the flowback composition stream and control the first flow rate to a second flow rate by regulating the flowback composition stream to a second pressure that is different than the first pressure, wherein the coupler assembly is configured to regulate the flowback composition stream to the second pressure based, at least in part, on a flowback molar rate of the flowback composition stream; and a discharge assembly coupled in flow communication to said coupler assembly and comprising:

a separator coupled in flow communication to said regulating valve and configured to separate the regulated flowback composition stream into a first gas stream and a condensed stream having at least one of a gas, proppant, oil, and water;

a degasser coupled in flow communication to said separator and configured to degas a carbon dioxide rich gas from the condensed stream; and a flow modulator coupled in flow communication to said separator and said degasser and configured to mix the carbon dioxide rich gas and the first gas stream to produce a second gas stream having a third flow rate and a third pressure and configured to control the third flow rate by regulating the third pressure to a fourth pressure that is different than the third pressure.

12. The modular assembly of claim 11 further comprising a compressor coupled in flow communication to and between said degasser and said flow modulator.

13. The modular assembly of claim 11, wherein said flow modulator is configured to manage the third flow rate to a fourth flow rate.

14. The modular assembly of claim 11, wherein said flow modulator is configured to modulate the third pressure to the fourth pressure.

15. The modular assembly of claim 11, wherein the first pressure has a range from about 50 psi to about 5,000 psi, the second pressure has a range from about 50 psi to about 2,000 psi, the third pressure has a range from about 50 psi to about 800 psi, and the fourth pressure has a range from about 50 psi to about 800 psi.

16. The modular assembly of claim 11, wherein the first flow rate has a range from about 0.1 million Standard Cubic Feet Per Day ("scfd") to about 300 million scfd, the second flow rate has a range from about about 0.1 million scfd to about 200 million scfd, the third flow rate has a range from about 0.1 million scfd to 200 million scfd, and the fourth flow rate has a range from about 10,000 actual cubic feet per day to about 10 million actual cubic feet per day.

17. The modular assembly of claim 11 further comprising a gas processor assembly removably coupled in flow communication to said flow modulator and comprising a plurality of separation modules, each separation module of the plurality of separation modules configured to process the second gas stream into a carbon dioxide state of a plurality of carbon dioxide states to facilitate reuse of carbon dioxide gas of the second gas stream.

18. The modular assembly of claim 11 further comprising a collector coupled in flow communication to said separator and configured to receive at least one of the proppants, oil, and water.

19. A method of assembling a modular assembly for processing a flowback composition stream from a well head, said method comprising:

coupling a coupler assembly to the well head, the coupling assembly comprising a regulating valve configured to receive the flowback composition stream having a first flow rate and a first pressure and control the first flow rate to a second flow rate by regulating the flowback composition stream to a second pressure that is different than the first pressure based, at least in part, on a flowback molar rate of the flowback composition stream;

coupling a separator in flow communication to the regulating valve and configured to separate the regulated flowback composition stream into a first gas stream having a third pressure and third flow rate and a having condensed stream;

coupling a degasser in flow communication to the separator and configured to degas a carbon dioxide rich gas from the condensed stream; and coupling a flow modulator in flow communication to the separator and the degasser and configured to mix the carbon dioxide rich gas and the first gas stream to produce a second gas stream having a third flow rate and a third pressure and configured to control the third flow rate by regulating the third pressure to a fourth pressure that is different than the third pressure.

20. The method of claim 19 further comprising coupling a compressor in flow communication to the flow modulator.

21. A method for processing a flowback composition stream from a well head, said method comprising:

receiving the flowback composition stream from the well head, the flowback composition stream having an initial flow rate and an initial pressure;

controlling the initial rate to an intermediate flow rate by regulating the flowback composition stream to an intermediate pressure that is less than the initial pressure based, at least in part, on a flowback molar rate of the flowback composition stream;

discharging the regulated flowback composition stream to a separator;

separating the regulated flowback composition stream into a first gas stream and a condensed stream;

discharging the condensed stream to a degasser;

degassing a carbon dioxide rich gas from the condensed stream;

mixing the carbon dioxide rich gas with the first gas stream to produce a second gas stream;

discharging the second gas stream to a flow modulator; and controlling the second gas stream to a final flow rate by regulating the second gas stream to a final pressure that is less than the intermediate pressure.

* * * * *